US006062233A

United States Patent [19]

Williams

[11] Patent Number: 6,062,233

[45] Date of Patent: May 16, 2000

[54] DISPOSABLE TOOTHBRUSH SYSTEM

[76] Inventor: Michael D. Williams, 1910 Laurel Rose La., Houston, Tex. 77014

[21] Appl. No.: 09/285,223

[22] Filed: Apr. 1, 1999

[51] Int. Cl.[7] ..... A45D 44/18

[52] U.S. Cl. ..... 132/309; 132/308; 401/268; 206/63.5

[58] Field of Search ..... 132/308, 309, 132/311, 286, 313; 206/581, 209.1, 362.2, 460, 368, 63.5; 401/268, 132, 123, 125; 15/167.1

[56] References Cited

U.S. PATENT DOCUMENTS

| | | | |
|---|---|---|---|
| 2,082,834 | 6/1937 | Hofmann | 132/308 |
| 2,090,144 | 8/1937 | Palimeri | 15/167 |
| 2,223,952 | 12/1940 | Darmody | 132/308 |
| 2,484,627 | 10/1949 | Lennox | 132/308 |
| 2,807,818 | 10/1957 | Taylor | 15/136 |
| 3,417,762 | 12/1968 | Hall | 132/84 |
| 3,738,762 | 6/1973 | Moore et al. | 401/186 |
| 3,842,851 | 10/1974 | Pipitone | 132/311 |
| 3,879,139 | 4/1975 | Dahl et al. | 401/135 |
| 3,936,200 | 2/1976 | O'Rourke | 401/184 |
| 4,155,663 | 5/1979 | Cerquozzi | 401/135 |
| 4,521,128 | 6/1985 | O'Neal | 401/183 |
| 4,530,129 | 7/1985 | Labick et al. | 132/308 |
| 4,582,075 | 4/1986 | O'Neal et al. | 132/84 |
| 4,850,730 | 7/1989 | Jimenez et al. | 401/184 |
| 5,490,736 | 2/1996 | Haber et al. | 401/132 |
| 5,584,593 | 12/1996 | Lafortune | 401/184 |
| 5,599,126 | 2/1997 | Hough | 401/184 |

*Primary Examiner*—Gene Mancene
*Assistant Examiner*—Pedro Philogene
*Attorney, Agent, or Firm*—Joseph N. Breaux

[57] ABSTRACT

A disposable toothbrush system that includes a toothbrush and a one use supply of toothpaste that is easily carried in a pocket or the like and discarded after use. The disposable toothbrush system is packaged suitable for sale through vending machines and that includes a tubular, plastic film, outer package, a disposable toothbrush, and a toothpaste dispensing bladder assembly. The toothpaste dispensing bladder assembly includes a seamless, non-elastic, plastic film bladder member filled with toothpaste and has a dispensing end thereof adhesively attached to an interior surface of the tubular film outer package and heat sealed and crimped between two edge sections of the first end of the tubular, plastic film, outer package.

1 Claim, 2 Drawing Sheets

DISPOSABLE TOOTHBRUSH SYSTEM

TECHNICAL FIELD

The present invention relates to oral hygiene products and more particularly to a disposable toothbrush system that includes a tubular, plastic film, outer package, a disposable toothbrush, and a toothpaste dispensing bladder assembly; the tubular, plastic film, outer package having heat sealed and crimped first and second ends and an interior compartment; the disposable toothbrush being sealed within the interior compartment formed within the outer package; the toothpaste dispensing bladder assembly including a seamless, non-elastic, plastic film bladder member having a toothpaste cavity defined therein that is filled with toothpaste through a fill opening that is heat sealed and crimped to form a dispensing end; the dispensing end being adhesively attached to an interior surface of the tubular film outer package adjacent to the first end and heat sealed and crimped between two edge sections of the first end; the toothpaste cavity being filled with a sufficient quantity of toothpaste such that the dispensing end is rupturable by squeezing the seamless, non-elastic, plastic film bladder member.

BACKGROUND ART

Many individuals often find it desirable to brush after each meal, however, this can be difficult when dining out. It would be a benefit, therefore, to have a disposable toothbrush system that included a toothbrush and a one use supply of toothpaste that could be easily carried in a pocket or the like and discarded after use. Because it is not always possible to anticipate when and where meals will be taken, it would also be desirable to have such a disposable toothbrush system that was packaged in a manner that was suitable for sale through vending machines.

GENERAL SUMMARY DISCUSSION OF INVENTION

It is thus an object of the invention to provide a disposable toothbrush system that includes system that includes a toothbrush and a one use supply of toothpaste that is easily carried in a pocket or the like and discarded after use.

It is a further object of the invention to provide a disposable toothbrush system that is packaged in a manner suitable for sale through vending machines.

It is a still further object of the invention to provide a disposable toothbrush system that includes a tubular, plastic film, outer package, a disposable toothbrush, and a toothpaste dispensing bladder assembly; the tubular, plastic film, outer package having heat sealed and crimped first and second ends and an interior compartment; the disposable toothbrush being sealed within the interior compartment formed within the outer package; the toothpaste dispensing bladder assembly including a seamless, non-elastic, plastic film bladder member having a toothpaste cavity defined therein that is filled with toothpaste through a fill opening that is heat sealed and crimped to form a dispensing end; the dispensing end being adhesively attached to an interior surface of the tubular film outer package adjacent to the first end and heat sealed and crimped between two edge sections of the first end; the toothpaste cavity being filled with a sufficient quantity of toothpaste such that the dispensing end is rupturable by squeezing the seamless, non-elastic, plastic film bladder member.

It is a still further object of the invention to provide a disposable toothbrush system that accomplishes all or some of the above objects in combination.

Accordingly, a disposable toothbrush system is provided. The disposable toothbrush system includes a tubular, plastic film, outer package, a disposable toothbrush, and a toothpaste dispensing bladder assembly; the tubular, plastic film, outer package having heat sealed and crimped first and second ends and an interior compartment; the disposable toothbrush being sealed within the interior compartment formed within the outer package; the toothpaste dispensing bladder assembly including a seamless, non-elastic, plastic film bladder member having a toothpaste cavity defined therein that is filled with toothpaste through a fill opening that is heat sealed and crimped to form a dispensing end; the dispensing end being adhesively attached to an interior surface of the tubular film outer package adjacent to the first end and heat sealed and crimped between two edge sections of the first end; the toothpaste cavity being filled with a sufficient quantity of toothpaste such that the dispensing end is rupturable by squeezing the seamless, non-elastic, plastic film bladder member. The heat sealed and crimped second end of the tubular, plastic film, outer package has a vending aperture formed therethrough for connection with a helical screw type vending machine.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
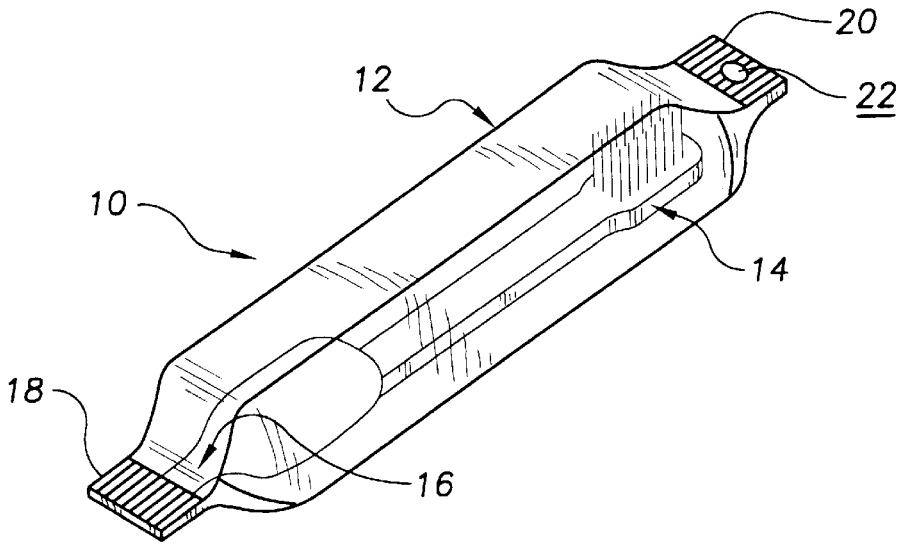
FIG. 1 is a perspective view of an exemplary embodiment of the disposable toothbrush system of the present invention showing a tubular, plastic film, outer package having heat sealed and crimped first and second ends; a disposable toothbrush sealed within an interior compartment formed within the outer package; and a toothpaste dispensing bladder assembly including a seamless, non-elastic, plastic film bladder member having a toothpaste cavity defined therein that is filled with toothpaste through a fill opening that is heat sealed and crimped to form a dispensing end; the dispensing end being adhesively attached to an interior surface of the tubular film outer package adjacent to the first end and heat sealed and crimped between the two edge sections of the first end; the toothpaste cavity being filled with a sufficient quantity of toothpaste such that the dispensing end is rupturable by squeezing the seamless, non-elastic, plastic film bladder member.

FIG. 1 shows an exemplary embodiment of the disposable toothbrush system of the present invention generally designated 10. Disposable toothbrush system 10 includes a tubular, plastic film, outer package, generally designated 12; a disposable toothbrush, generally designated 14; and a toothpaste dispensing bladder assembly, generally designated 16.

Figure 2:
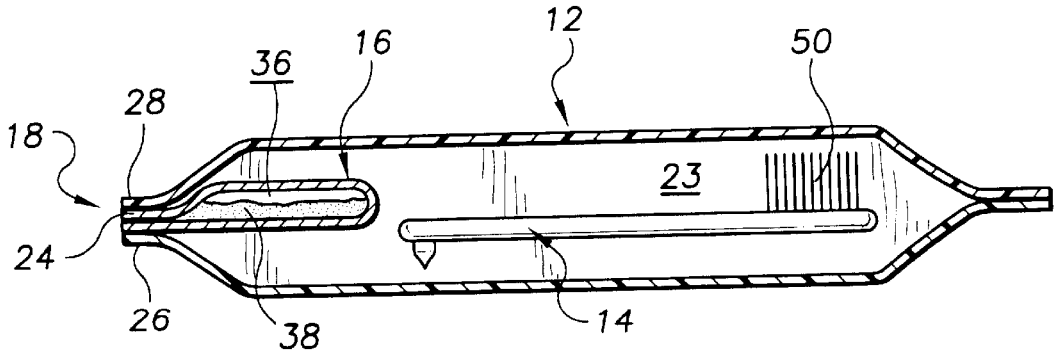
FIG. 2 is a side plan view of the exemplary disposable toothbrush system of FIG. 1 with the facing side surface of the tubular, plastic film, outer package removed to show the interior compartment formed within the tubular, plastic film, outer package by heat sealing and crimping the first and second ends; the disposable toothbrush sealed within the interior compartment and including a handle having a brush at one end and a resilient tooth pick at the other; and the toothpaste dispensing bladder assembly with the dispensing end thereof heat sealed and crimped between the two edge sections of the first end.
Figure 3:
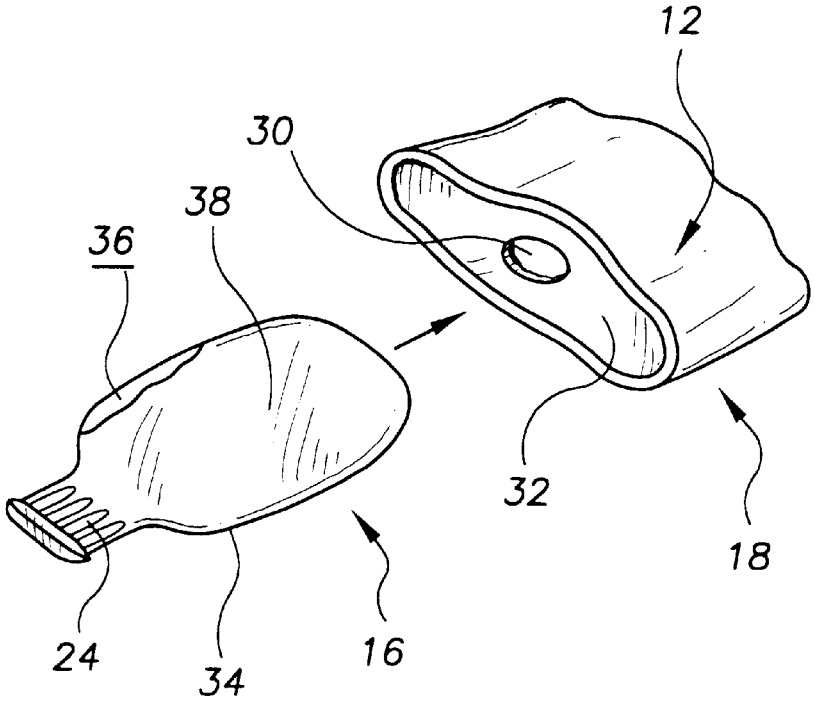
FIG. 3 is a detail perspective view showing the toothpaste dispensing bladder assembly and a quantity of adhesive deposited on an interior surface of the tubular film outer package adjacent to the first end thereof prior to heat sealing and crimping of the first end.
Figure 4:
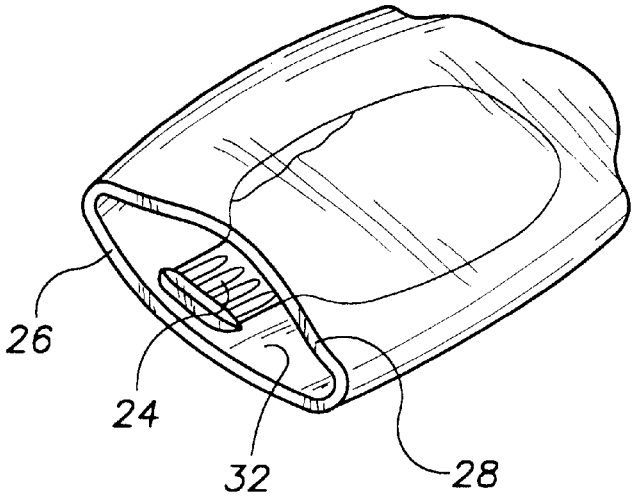
FIG. 4 is a detail perspective view showing the dispensing end of the toothpaste dispensing bladder assembly adhesively attached to the interior surface of the tubular film outer package adjacent to the first end thereof.

Tubular, plastic film, outer package 12 has heattsealed and crimped first and second ends 18,20, respectively. Second end 20 has a vending aperture 22 formed therethrough for connection with a helical screw type vending machine if desired. Referring now to FIG. 2, tubular, plastic film, outer package 12 has disposable toothbrush 14 sealed within an interior compartment 23 and has a dispensing end 24 of toothpaste dispensing bladder assembly 16 secured between two edge sections 26,28 of first end 18. Referring to FIG. 3, toothpaste dispensing bladder assembly 16 includes a seamless, non-elastic, plastic film bladder member 34 having a toothpaste cavity 36 defined therein that is filled with a quantity of toothpaste 38 and the opening heat sealed and crimped to form dispensing end 24. During assembly, a quantity of adhesive 30 is deposited on an interior surface 32 of the tubular film outer package 12 adjacent to first end 18, referring to FIG. 4, which is used to adhesively attach dispensing end 24 to interior surface 32 prior to, referring back to FIG. 2, heat sealing and crimping first end 18 such that dispensing end 24 is sealed and secured between the two edge sections 26,28.

With general reference to FIGS. 1–4, disposable toothbrush system 10 is used by tearing open second end 20 of tubular film outer package 12 and removing toothbrush 14. First end 18 is then held over the bristles 50 of toothbrush 14 and seamless, non-elastic, plastic film bladder member 34 squeezed between the thumb and forefinger until dispensing end 24 ruptures and toothpaste 38 is dispensed onto bristles 50. Toothbrush 14 is then used and discarded along with tubular film outer package 12.

It can be seen from the preceding description that a disposable toothbrush system has been provided that includes a toothbrush and a one use supply of toothpaste that is easily carried in a pocket or the like and discarded after use; that is packaged in a manner suitable for sale through vending machines; and that includes a tubular, plastic film, outer package, a disposable toothbrush, and a toothpaste dispensing bladder assembly; the tubular, plastic film, outer package having heat sealed and crimped first and second ends and an interior compartment; the disposable toothbrush being sealed within the interior compartment formed within the outer package; the toothpaste dispensing bladder assembly including a seamless, non-elastic, plastic film bladder member having a toothpaste cavity defined therein that is filled with toothpaste through a fill opening that is heat sealed and crimped to form a dispensing end; the dispensing end being adhesively attached to an interior surface of the tubular film outer package adjacent to the first end and heat sealed and crimped between two edge sections of the first end; the toothpaste cavity being filled with a sufficient quantity of toothpaste such that the dispensing end is rupturable by squeezing the seamless, non-elastic, plastic film bladder member.

It is noted that the embodiment of the disposable toothbrush system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A disposable toothbrush system comprising:

a tubular, plastic film, outer package;

a disposable toothbrush; and a toothpaste dispensing bladder assembly;

said tubular, plastic film, outer package having heat sealed and crimped first and second ends and an interior compartment;

said disposable toothbrush being sealed within said interior compartment formed within said outer package;

said toothpaste dispensing bladder assembly including a seamless, non-elastic, plastic film bladder member having a toothpaste cavity defined therein that is filled with toothpaste through a fill opening that is heat sealed and crimped to form a dispensing end;

said dispensing end being adhesively attached to an interior surface of said tubular film outer package adjacent to said first end and heat sealed and crimped between two edge sections of said first end;

said toothpaste cavity being filled with a sufficient quantity of toothpaste such that said dispensing end is rupturable by squeezing said seamless, non-elastic, plastic film bladder member.

* * * * *